US010820768B2

(12) United States Patent
Gunter et al.

(10) Patent No.: US 10,820,768 B2
(45) Date of Patent: Nov. 3, 2020

(54) WET CLEANING DEVICE WITH A CLEANING ROLLER THAT IS ROTATABLE AROUND A ROLLER AXIS

(71) Applicant: Vorwerk & Co. Interholding GmbH, Wuppertal (DE)

(72) Inventors: Christoph Gunter, Wuppertal (DE); Hannes Buesing, Aachen (DE); Jochen Jentsch, Berlin (DE)

(73) Assignee: Vorwerk & Co. Interholding GmbH, Wuppertal (DE)

( * ) Notice: Subject to any disclaimer, the term of this patent is extended or adjusted under 35 U.S.C. 154(b) by 77 days.

(21) Appl. No.: 16/312,464

(22) PCT Filed: Jun. 16, 2017

(86) PCT No.: PCT/EP2017/064745
§ 371 (c)(1),
(2) Date: Dec. 21, 2018

(87) PCT Pub. No.: WO2018/001753
PCT Pub. Date: Jan. 4, 2018

(65) Prior Publication Data

US 2019/0125156 A1 May 2, 2019

(30) Foreign Application Priority Data

Jun. 28, 2016 (DE) ..... 10 2016 111 806

(51) Int. Cl.
*A47L 11/292* (2006.01)
*A47L 11/40* (2006.01)

(52) U.S. Cl.
CPC ..... *A47L 11/292* (2013.01); *A47L 11/4041* (2013.01); *A47L 11/4088* (2013.01); *A47L 11/4044* (2013.01); *A47L 11/4083* (2013.01)

(58) Field of Classification Search
CPC ..... A47L 11/292; A47L 11/4088; A47L 11/4044; A47L 11/4083; A47L 11/4069;
(Continued)

(56) References Cited

U.S. PATENT DOCUMENTS 1,536,687 A 5/1925 Oatey
2,642,617 A * 6/1953 Lilly ..... A47L 11/40 15/388
(Continued)

FOREIGN PATENT DOCUMENTS

DE 102 29 611 B3 1/2004
DE 20 2009 013 434 U1 12/2009
(Continued)

OTHER PUBLICATIONS

International Search Report of PCT/EP2017/064359, dated Sep. 5, 2017.
(Continued)

*Primary Examiner* — Robert J Scruggs
(74) *Attorney, Agent, or Firm* — Collard & Roe, P.C.

(57) ABSTRACT

A wet cleaning device, has a cleaning roller that is rotatable about a roller axis, the cleaning roller having a cleaning covering. The wet cleaning device has a deceleration element and a guide element for supporting the removal and discharge of liquid and/or dirt from the cleaning roller to a liquid channel. The deceleration element has an impact edge in opposite direction to the fibers of the rotating cleaning covering, wherein the guide element is arranged in the direction of rotation of the cleaning roller behind the impact edge. During a regeneration operation of the wet cleaning device, the impact edge is arranged so far apart between the fibers of the cleaning covering that free ends of the fibers project outward in the radial direction beyond the impact
(Continued)

edge, and in the event of an impact on the impact edge, are deflected in the direction of the guide element.

11 Claims, 5 Drawing Sheets

(58) Field of Classification Search
CPC ..... A47L 11/4038; A47L 11/4075; A47L 11/4041; A47L 11/4058; A47L 13/22; A47L 11/085; A47L 11/18; A47L 11/293; A47L 11/28; A47L 11/282; A47L 11/40
See application file for complete search history.

(56) References Cited

U.S. PATENT DOCUMENTS 4,875,246 A * 10/1989 MacGregor ..... A47L 11/185 15/98
5,657,504 A 8/1997 Khoury
9,289,105 B2 3/2016 Moes
2006/0048321 A1* 3/2006 Boyer ..... A47L 13/144 15/119.2
2007/0011838 A1* 1/2007 Davis ..... A63D 5/10 15/230
2009/0229075 A1* 9/2009 Eriksson ..... A47L 9/0477 15/383

FOREIGN PATENT DOCUMENTS

DE 10 2014 119 188 A1 6/2016
EP 0 898 924 A1 3/1999

OTHER PUBLICATIONS

International Search Report of PCT/EP2017/064748, dated Sep. 22, 2017.
International Search Report of PCT/EP2017/064357, dated Oct. 16, 2017.
International Search Report of PCT/EP2017/064365, dated Sep. 20, 2017.
International Search Report of PCT/EP2017/064745, dated Sep. 20, 2017.

* cited by examiner 15
14
1
12
16
13
2
3
x

WET CLEANING DEVICE WITH A CLEANING ROLLER THAT IS ROTATABLE AROUND A ROLLER AXIS

CROSS REFERENCE TO RELATED APPLICATIONS

This application is the National Stage of PCT/EP2017/064745 filed on Jun. 16, 2017, which claims priority under 35 U.S.C. § 119 of German Application No. 10 2016 111 806.0 filed on Jun. 28, 2016, the disclosures of which are incorporated by reference. The international application under PCT article 21(2) was not published in English.

FIELD OF TECHNOLOGY

The invention relates to a wet cleaning device, in particular to a wet wiping device, with a cleaning roller that is rotatable around a roller axis and has a cleaning covering.

The invention further relates to a method for operating a wet cleaning device, in particular to a wet wiping device, in which liquid and/or dirt is removed from a cleaning covering of a cleaning roller of the wet cleaning device that rotates around a roller axis.

PRIOR ART

Wet cleaning devices or methods for operating a wet cleaning device are known in prior art.

For example, DE 102 29 611 B3 discloses a wet cleaning device with a wiping body rotatably drivable around a rotational axis, in which a cleaning liquid is removed from a storage tank and sprayed onto the surface of the wiping body by means of spray nozzles arranged in the direction of the rotational axis of the wiping body. The wiping body wetted in this way is guided over a surface to be cleaned during a wiping operation, wherein the wiping body picks up dirt from the surface to be cleaned.

During the wiping operation, the wiping body is increasingly covered with dirt, making it necessary to regenerate the wiping body. To this end, the wiping body is lifted from the surface to be cleaned, enclosed in a housing and sprayed with unused cleaning liquid. The wiping body rotates, so that cleaning liquid and/or dirt are driven out of the wiping body, impact the interior side of the housing, and are transferred into a recovery tank. The disadvantage here is that a large amount of cleaning liquid is required for cleaning the wiping body during the regeneration process, so that dirt accumulated on the wiping body can be spun off by the centrifugal forces acting on the dirt or cleaning liquid during the rotation of the wiping body.

SUMMARY OF THE INVENTION

Proceeding from the aforementioned prior art, the object of the invention is to provide a wet cleaning device of the aforementioned kind that enables a regeneration of the cleaning roller with the best possible result, and in particular with the lowest possible use of liquid and a short regeneration time.

In order to achieve the aforementioned object, a wet cleaning device is initially proposed, which has a deceleration element and a guide element for supporting the removal and discharge of liquid and/or dirt from the cleaning roller to a liquid channel, wherein the deceleration element has an impact edge that opposes the fibers of the rotating cleaning covering, wherein the guide element is arranged in the rotational direction of the cleaning roller behind the impact edge, and wherein, during a regeneration operation of the wet cleaning device, the impact edge is arranged so far between the fibers of the cleaning covering that free ends of the fibers project outwardly in a radial direction beyond the impact edge, and in the event of an impact on the impact edge are deflected in the direction of the guide element.

According to the invention, the cleaning covering of the cleaning roller is now no longer generated exclusively by spinning liquid and/or dirt from the fibers of the cleaning covering facing radially outward owing to the rotation of the cleaning roller. Instead, a deceleration element and a guide element are now allocated to the cleaning roller, in particular to the fibers of the cleaning covering, wherein the deceleration element is designed to decelerate the fibers of the cleaning covering that rotates around the roller axis, so that the latter are abruptly decelerated by the deceleration element, and their free ends bend over the impact edge of the deceleration element, and wherein the guide element is designed and arranged in such a way as to guide the liquid or dirt spun from the bent fibers to a liquid channel. The inertia of the abruptly decelerated fibers and the new rotational midpoint of the fibers on the deceleration element produces a whip effect, in which adhering liquid and/or adhering dirt between the fibers of the cleaning covering are ripped out, and get to the liquid channel via the guide element. The free ends of the fibers bent over the impact edge of the deceleration element can reach accelerations more than seven times higher than the acceleration achieved solely through the centrifugal force around the roller axis.

A central component of the invention consists of the deceleration element with the following guide element for discharging the liquid or dirt removed from the fibers by means of the deceleration element. In order to dissolve the liquid or dirt, the deceleration element is lowered into the cleaning covering of the rotating cleaning roller. The fibers of the cleaning covering are made to straighten in front of the deceleration element by exposure to the centrifugal forces (as the fibers stretch), and move around the roller axis with the angular velocity of the cleaning roller. The fibers are abruptly stopped at the deceleration element, wherein the free ends of the fibers move around the new rotational midpoint on the deceleration element with an increased angular velocity. The free ends of the fibers bend around the impact edge in the direction of the guide element, wherein the forces that stopping on the deceleration element exerts on the fibers exceed the centrifugal force produced exclusively by the rotation of the cleaning roller around the roller axis (without a deceleration element) many times over. Dirt contained in the cleaning covering is dissolved by the impact and spun out, specifically in the direction of the guide element, which then feeds the liquid and dirt to a liquid channel, for example which empties into a wastewater tank. As the cleaning roller continues to rotate, the fibers of the cleaning covering are pulled through under the deceleration element. Drawing back the fibers additionally strips and presses them on the deceleration element. Finally, the fibers can once again straighten in back of the deceleration element, and any still adhering liquid or adhering dirt can be spun off.

The liquid or dirt dissolved by bending the free ends of the fibers have a kinetic energy imparted to them by the rotation of the cleaning roller that leads to a spinning off onto the guide element. The guide element guides the liquid and dirt to the liquid channel, and on the other hand makes the latter incapable of once again dripping onto the cleaning covering.

The deceleration element is arranged in such a way relative to the cleaning covering of the cleaning roller that a free distance exists between the deceleration element and roots of the fibers on the one hand, and a free distance exists between the impact edge and outer end region of the free ends of the fibers on the other. As a result, the free ends of the fibers have a range of motion to bend over the impact edge when impacting the impact edge of the deceleration element, and fibers can be pulled away from the impact edge as the cleaning roller continues to rotate in the direction opposite the bending, and passed between the cleaning roller and deceleration element.

It is proposed that the deceleration element be immovably arranged on the wet cleaning device during the regeneration operation. As a consequence, the deceleration element is fixed in place relative to the wet cleaning device, while the fibers of the cleaning covering are moved against the deceleration element by the rotation of the cleaning roller. However, it can alternatively be provided that the deceleration element be moved in a direction opposite the rotational direction of the cleaning roller during the regeneration operation. This makes it possible to further increase the speed at which the fibers of the cleaning covering impact the deceleration element.

In addition, it is proposed that the deceleration element and the guide element be designed as a shared element. In particular, it is proposed that the deceleration element and guide element together be designed as an arched element, which is convexly curved on a side facing away from the cleaning roller, and concavely curved on a side facing toward the cleaning roller. The integral design of the deceleration element with the guide element creates a fluid-tight bond between the deceleration element and guide element, so that liquid spun onto the deceleration element by the fibers of the cleaning covering cannot flow through the deceleration element and guide element, in particular drip onto the cleaning roller. In addition, the integral configuration also offers advantages while mounting the deceleration element or guide element onto the wet cleaning device. Fewer assembly means and fewer manipulations are necessary for mounting the shared element. The arched configuration of the shared element is especially suited for enabling an impact of the folded free ends of the fibers on the guide element on the convexly curved side facing away from the cleaning roller, and thus achieving an additional cleaning effect due to the impact of the free ends on the guide element. The convex curvature also ensures that the liquid or dirt can be guided along the negative inclination of the surface to the liquid channel by gravity. The opposing, concavely curved side of the shared element pointing toward the cleaning roller is concavely curved, so that the free ends of the fibers can straighten again as soon as possible under the shared element as the cleaning roller continues to rotate.

In addition, it is proposed that the impact edge of the deceleration element be concavely curved. As a result, the fibers of the cleaning covering are guided as gently as possible around the deceleration element or impact edge on the one hand, thereby increasing the life of the cleaning covering, and it becomes easier to deflect the free ends of the fibers in the direction of the guide element on the other.

The impact edge of the deceleration element preferably has a height measuring roughly one third of a fiber length of the fibers. This makes it possible to achieve a sufficient distance in a radial direction (relative to the roller axis) both below and above the impact edge, which is suitable for pulling back the fibers under the deceleration element or deflecting the free ends of the fibers over the deceleration element.

Furthermore, it is proposed that the impact edge have a distance to the fiber roots of the fibers measuring one fourth to one half a fiber length of the fibers in a radial direction relative to the roller axis. This distance is sufficient for pulling the fibers between the deceleration element and fiber roots of the fibers without causing damage to the cleaning covering. On the other hand, this distance is small enough that an additional stripping effect of the fibers can be achieved between the cleaning roller and deceleration element.

It is further proposed that the guide element extend proceeding from the deceleration element to the liquid channel in the rotational direction of the cleaning roller, in particular forming an elongation of a channel wall of the liquid channel. This configuration enables a loss-free transport of liquid or dirt from the deceleration element into the liquid channel. As a consequence, the guide element is preferably an end region of a channel wall that has an arched shape as proposed above.

In addition, it is proposed that the guide element and/or deceleration element be mounted so that it can be displaced, in particular swiveled, relative to the cleaning roller, in particular on a channel wall of the liquid channel. The deceleration element or guide element is usually only required during the regeneration operation of the cleaning roller. Therefore, it is recommended that the deceleration element be removed from the cleaning covering of the cleaning roller, i.e., displaced away from the cleaning roller, before performing a wiping operation. Accordingly, the guide element should also be displaced away from the cleaning roller. If the deceleration element and guide element are designed as a shared element, the displacement correspondingly takes place simultaneously. The deceleration element and/or guide element is displaceably arranged on the wet cleaning device, for example so that the latter can be swiveled toward the cleaning roller and swiveled away from the cleaning roller. A swiveling arm can correspondingly be provided for this purpose. Of course, it is alternatively also possible for the displacement to take place in some other way, e.g., by linearly shifting the deceleration element or guide element. In the event that the guide element and deceleration element are designed as a shared element as proposed above, a single displacement movement is of course sufficient to displace both the guide element and deceleration element relative to the cleaning roller.

In addition, it is proposed that at least one nozzle be allocated to the deceleration element and/or guide element for discharging liquid onto the cleaning roller, wherein the deceleration element and/or guide element can be arranged relative to a liquid outlet direction of the nozzle at an angle of between 90° and 170°, in particular between 90° and 105°, so that liquid discharged from the nozzle accelerated against the deceleration element and/or guide element reaches the cleaning roller along the deceleration element and/or guide element through exposure to gravity. As a result of this preferable configuration, the deceleration element and/or guide element now provides a guide surface on which liquid can flow from a nozzle to the cleaning roller. The guide surface of the deceleration element or guide element is the cleaning roller, and hence also faces toward the cleaning covering. As a result, the liquid exiting the nozzle is no longer applied directly on the cleaning roller, but rather initially on the deceleration element and/or guide element, and from there on the cleaning roller. The term liquid is here also understood as a vapor, liquid droplet, spray mist or the like. The nozzle is preferably arranged relative to the deceleration element or guide element in such a way that the accelerated liquid exiting the nozzle in a liquid outlet direction impacts the deceleration element and/or guide element, and there flows in the direction of the cleaning roller, wherein the liquid fans out into a liquid film after impacting the deceleration element or guide element. The liquid exiting the nozzle is advantageously accelerated by means of a pump, and exits the nozzle in a liquid outlet direction that deviates from a perpendicular direction. The liquid impacts the deceleration element and/or guide element essentially in this direction, wherein the force exerted on the liquid by the pump is high enough for the liquid to reach the deceleration element or guide element. The liquid generates a liquid spot on the deceleration element or guide element, proceeding from which portions of the liquid move essentially radially in all directions, e.g., even opposite the gravitational force. As the liquid gets further away from the nozzle, it orients itself increasingly more perpendicular owing to the gravitational direction, as a result of which the liquid fans out. By fanning out the liquid jet, the cleaning roller can be wetted homogeneously over its entire longitudinal extension. During the wetting process, the cleaning roller preferably rotates in such a way that a homogeneous wetting can be achieved over the entire circumferential surface of the cleaning roller. In order to allow the liquid applied to the deceleration element and/or guide element to fan out as widely as possible, and thereby wet as wide a surface of the cleaning roller as possible, the liquid should preferably be applied nearly perpendicularly on the deceleration element and/or guide element. It is recommended that there be an angle of between 90° and 170°, but in particular of between 90° and 105°, between the deceleration element and/or guide element and the liquid outlet direction of the nozzle. Practice has shown that an angle greater than 105° leads to a relevant reduction in the fanned out width of the liquid jet. In particular in combination with a previously proposed displaceability of the deceleration element and/or guide element relative to the cleaning roller, a suitable angle and a suitable distance between the surface of the cleaning roller and the deceleration element or guide element can be set.

In addition to the proposed wet cleaning device, the invention also proposes a method for operating a wet cleaning device, in which liquid and/or dirt are removed from a cleaning covering of a cleaning roller of the wet cleaning device rotating around a roller axis during a regeneration operation, and wherein a deceleration element and a guide element arranged behind the deceleration element in the rotational direction of the cleaning roller for removing and supplying the liquid and/or dirt from the cleaning roller to a liquid channel are arranged relative to the cleaning roller in such a way that an impact edge of the deceleration element projects between the fibers of the cleaning covering to such an extent that free ends of the fibers project outwardly in a radial direction beyond the impact edge, and during an impact on the impact edge are deflected in the direction of the guide element. The features and advantages of the method according to the invention are as described above in relation to the wet cleaning device.

In particular, it is proposed that the free ends of the fibers deflected at the impact edge impact the guide element, which in addition to a spinning off caused by the fibers stopping on the impact edge yields a cleaning effect resulting from the free ends hitting the guide element.

Finally, it is proposed that the liquid and/or dirt spun off by the fibers through impact on the impact edge and/or guide element be guided along the guide element in the liquid channel. In particular by integrally designing the deceleration element with the guide element and possibly even establishing a fluid-tight connection between the guide element and liquid channel as proposed above, the spun off liquid and/or dirt can be prevented from dripping back onto the cleaning roller, so that the liquid or dirt flows exclusively from the impact edge over the guide element to the liquid channel.

Within the meaning of the invention, wet cleaning devices are basically to be understood to encompass all those devices that can exclusively or among other things execute a wet cleaning process. These include on the one hand hand-operated and automatically movable wet cleaning devices, in particular cleaning robots as well, and on the other combined dry and wet cleaning devices, which can perform both a wet cleaning and dry cleaning process. Also intended within the meaning of the invention apart from the conventional floor cleaning devices for cleaning a floor are wet cleaning devices for cleaning above floor surfaces. For example, these include devices for cleaning windows and the like.

BRIEF DESCRIPTION OF THE DRAWINGS

The invention will be described in more detail below based on exemplary embodiments. Shown on.

DESCRIPTION OF THE EMBODIMENTS

Figure 1:
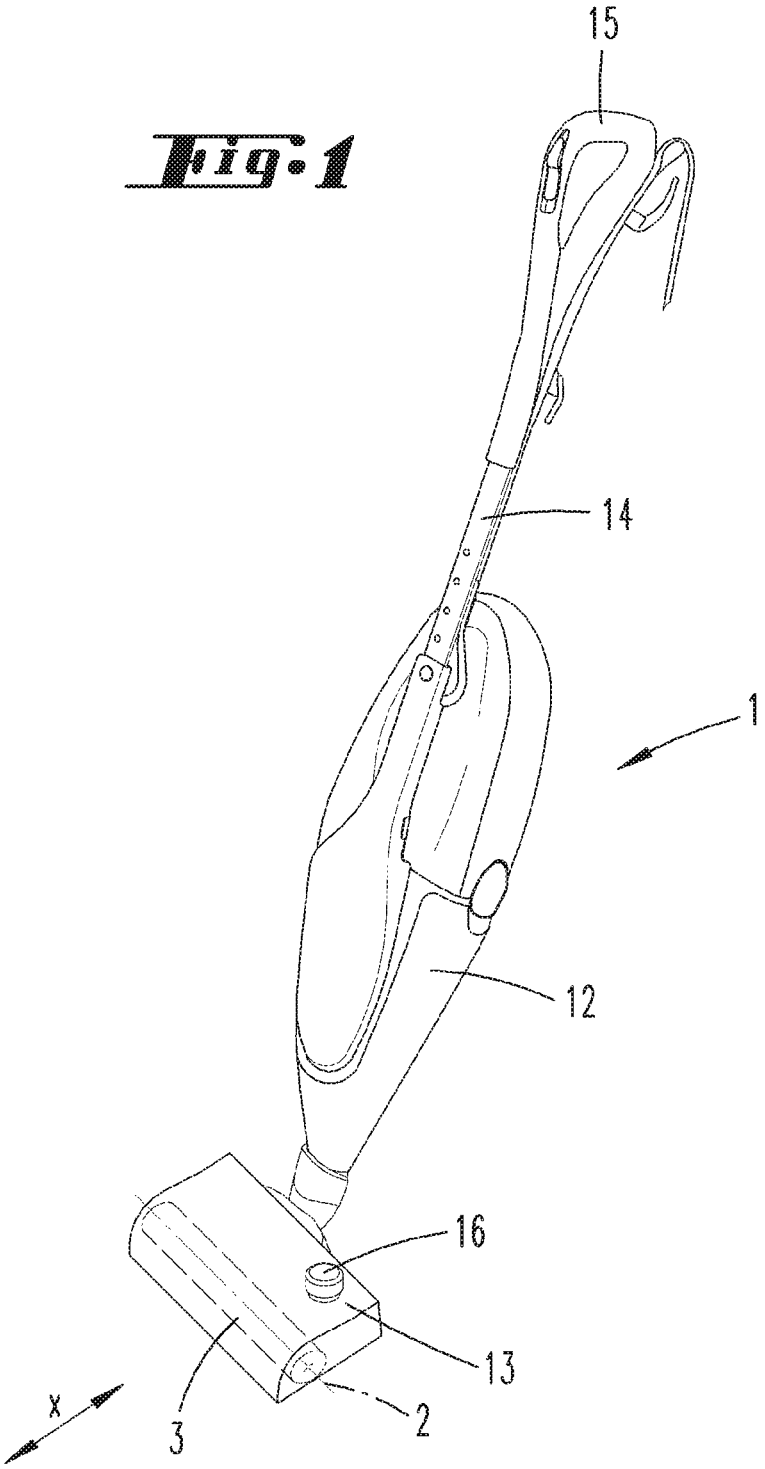
FIG. 1 is a wet cleaning device according to the invention.

FIG. 1 shows a wet cleaning device 1, which is here designed as a hand-operated wet cleaning device 1 with a base device 12 and an attachment 13. The attachment 13 is removably held on the base device 12. The base device 12 also has a handle 14, which is here telescoping in design, for example, so that a user of the wet cleaning device 1 can adjust the length of the handle 14 to his or her body size. Further arranged on the handle 14 is a handgrip 15, on which the user can guide the wet cleaning device 1 during a conventional wiping operation, i.e., slide it over a surface to be cleaned. During the wiping operation, the user usually guides the wet cleaning device 1 in the opposite direction of movement x over the surface to be cleaned. In the process, he or she alternately pushes the wet cleaning device 1 away from him or herself and pulls it back toward him or herself.

The attachment 13 has a cleaning roller 3 along with a filler neck 16, through which liquid can be filled into a liquid tank (not shown). The liquid stored in the liquid tank serves to externally wet the cleaning roller 3.

The cleaning roller 3 is mounted inside of the attachment 13 so that it can rotate around a roller axis 2. During a wiping operation, the cleaning roller 3 rotates around the roller axis 2, so that the circumferential surface of the cleaning roller 3 continuously rolls onto the surface to be cleaned. The cleaning roller 3 is wound with a cleaning covering 4 in the usual manner, possibly with an additional liquid-storing sponge body interspersed. For example, the cleaning covering 4 is here a textile cleaning cloth, between the fibers 6 of which liquid can be absorbed.

During the wiping operation, dirt is continuously deposited on the cleaning roller 3, i.e., in particular on the cleaning covering 4. Therefore, it may become necessary to regenerate the cleaning roller 3 after a specific period of operation, wherein dirt and liquid loaded with dirt are removed from the cleaning roller 3 during a regeneration operation.

Figure 2:
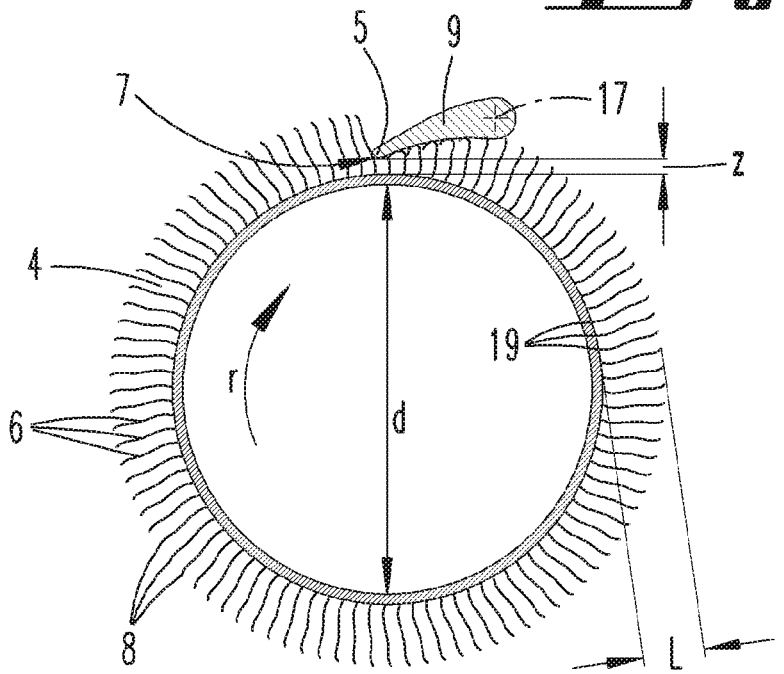
FIG. 2 is a rotating cleaning roller with a deceleration element and a guide element at a first point in time.
Figure 3:
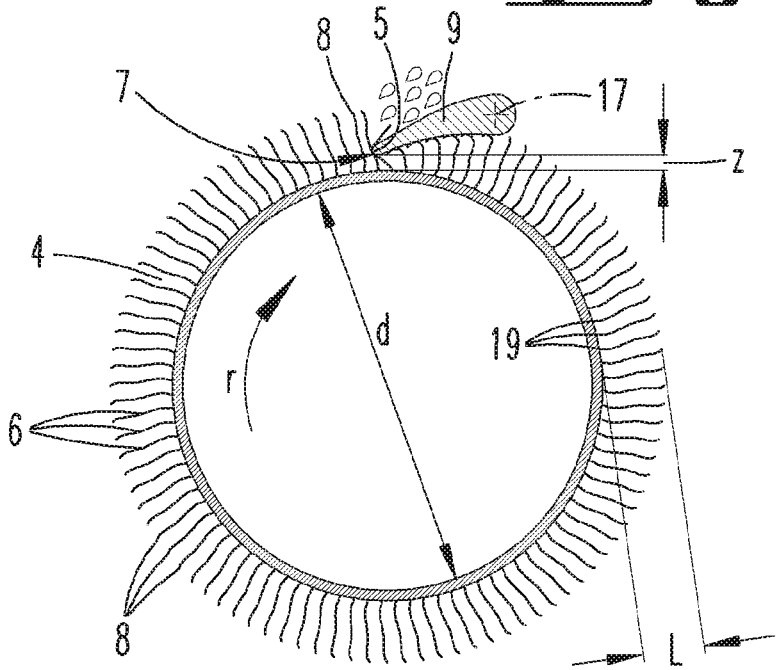
FIG. 3 is the cleaning roller, deceleration element and guide element at a second point in time.
Figure 4:
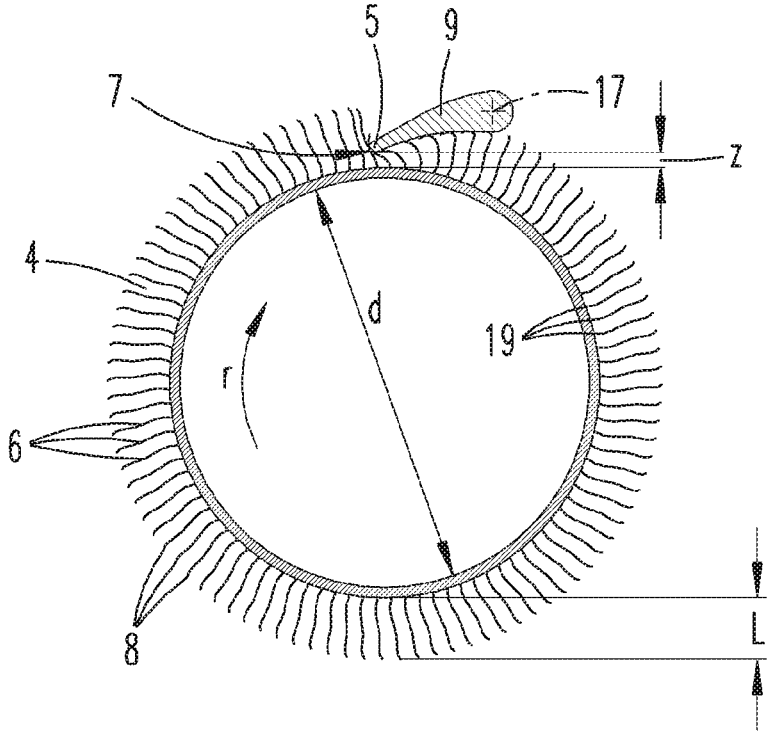
FIG. 4 is the cleaning roller, deceleration element and guide element at a third point in time.

FIGS. 2 to 4 each show the cleaning roller 3 with the cleaning covering 4, which has a plurality of fibers 6. The fibers 6 are only sketched in for illustrative purposes, since the number of fibers 6 is of course significantly higher in practice. For example, the cleaning covering 4 is here a microfiber textile. An integrally designed element comprised of a deceleration element 5 and a guide element 9 engages between the fibers 6 of the cleaning covering 4. The deceleration element 5 has an impact edge 7, which is curved in design. The impact edge 7 opposes a rotational direction r of the cleaning roller 3 essentially frontally, so that the fibers 6 moving around the roller axis 2 impact against the curved front region of the deceleration element 5. In a radial direction proceeding from the roller axis 2, the impact edge 7 of the deceleration element 5 has a height corresponding roughly to one third a fiber length L of the fibers 6. The deceleration element 5 is spaced apart in a radial direction from the fiber roots 19 of the fibers 6, which are fastened in the cleaning covering 4, by roughly a distance z of also one third of a fiber length L of the fibers 6. Finally, a free end 8 of the fibers 6 remains in a radial direction proceeding from the roller axis 2, and projects beyond the impact edge 7 of the deceleration element 5. The guide element 9 is integrally designed with the deceleration element 5, wherein the deceleration element 5 forms an end region that projects into the fibers 6, and the guide element 9 extends in the direction of a liquid channel 10 of the wet cleaning device 1, as will be explained later with reference to FIGS. 5 to 8. The deceleration element 5 and guide element 9 together form an arched element, which is convexly curved on a side facing away from the cleaning roller 3, and concavely curved on a side facing toward the cleaning roller 3.

In reference to FIGS. 2 to 4, the function of the deceleration element 5 and guide element 9 will initially be explained during contact between the fibers 6 and deceleration element 5, wherein FIGS. 2 to 4 show different points in time during a regeneration operation of the wet cleaning device 1, in which the cleaning roller 3 assumes sequential rotational positions in the rotational direction r.

FIG. 2 shows a first point in time, at which a fiber 6 that is still almost stretched (relative to a radial direction proceeding from the roller axis 2) impacts directly on the impact edge 7 of the deceleration element 5. Furthermore, other fibers 6 of the cleaning covering 4 are at the same point in time located under the guide element 9 (in the rotational direction r behind the deceleration element 5) or, in a mechanically unloaded, stretched form, in front of the deceleration element 5 in the rotational direction.

The fiber 6 currently impacting the impact edge 7 is deflected with its free end 8 around the impact edge 7 as illustrated on FIG. 3, wherein the free end 8 of the fiber 6 now no longer rotates around the roller axis 2 with a first rotational speed, but rather is accelerated around a new rotational center, which now is formed by the side of the impact edge 7 that faces radially outward. Since the rotational axis of the fibers 6 has now been reduced to the length of the free end 8 of the fibers 6, the free end 8 rotates around the new rotational midpoint at an elevated speed, and is deflected like a whip in the rotational direction r, i.e., toward the guide element 9. In an end stage of this movement, the free end 9 of the fibers 6 impacts the convexly curved surface of the guide element 9, and thereby additionally spins liquid and/or dirt from the fiber 6. The liquid or dirt is guided by the kinetic energy in the rotational direction r along the convex upper side of the guide element 9, wherein the flow in the direction of the liquid channel 10 of the wet cleaning device 1 is facilitated by the falling edge of the guide element 9.

FIG. 4 shows an ensuing point in time, at which the fiber 6 that previously impacted on the guide element 9 is again pulled away from the deceleration element 5 with the continued rotation of the cleaning roller 3, and is now pulled through between the deceleration element 5 and area of the fiber roots 19. This yields an additional stripping effect, as a result of which any liquid or dirt that might still be present on the fiber 6 is stripped away. As rotation continues proceeding from FIG. 4, the fiber 6 straightens again under the guide element 9, wherein the concave curvature of the side of the guide element 9 facing toward the cleaning roller 3 provides a corresponding free space in which the fibers 6 can straighten.

Figure 5:
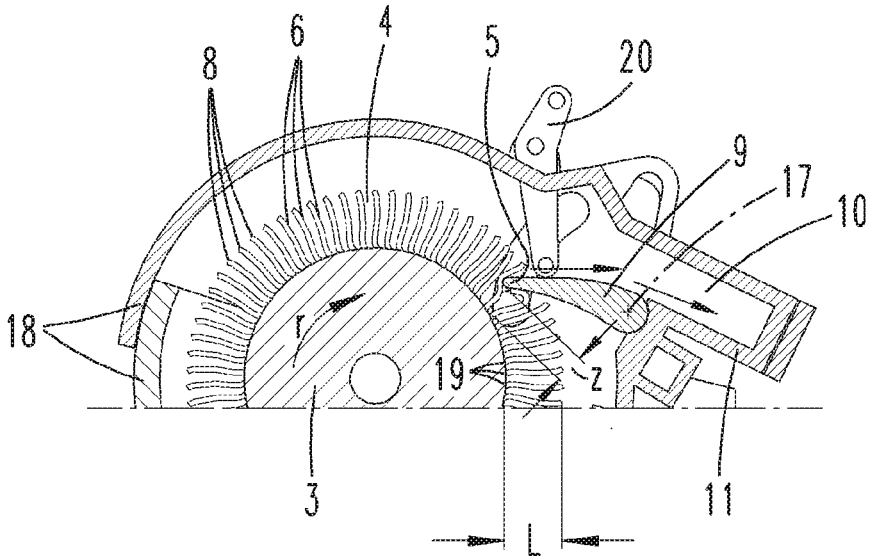
FIG. 5 is a partial area of the wet cleaning device with a deceleration element submerged into the cleaning covering.
Figure 6:
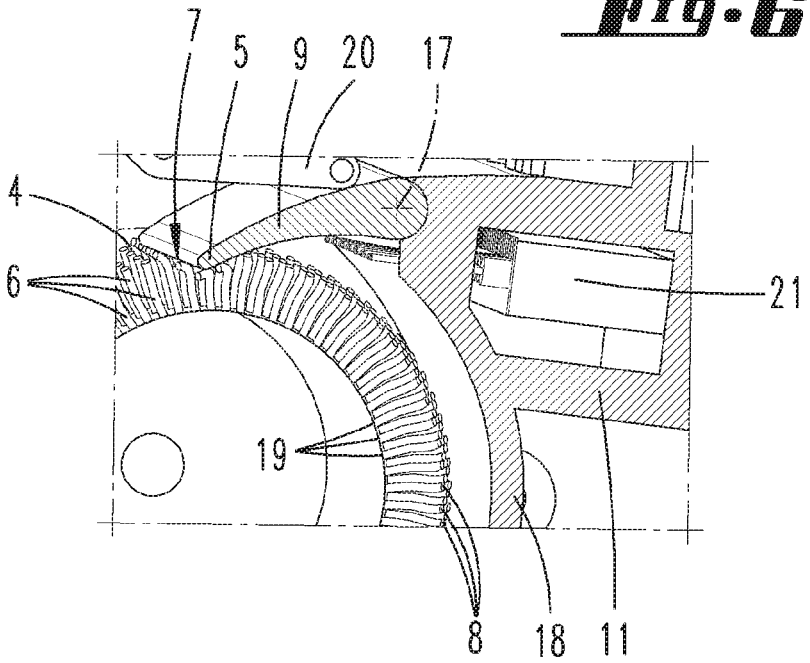
FIG. 6 is a partial area of the illustration on FIG. 5, with a magnified view of an impact edge of the deceleration element between fibers of the cleaning covering.

FIGS. 5 and 6 show the arrangement of the guide element 9 inside of the attachment 13 of the wet cleaning device 1. The end region of the guide element 9 facing away from the deceleration element 5 is pivoted to a channel wall 11 of the liquid channel 10, specifically around a swiveling axis 17. The guide element 9, and hence also the deceleration element 5 integrally designed with the guide element 9, can resultantly be displaced around the swiveling axis 17 relative to the cleaning roller 3. Depending on the respective operating mode of the wet cleaning device 1, the deceleration element 5 and guide element 9 can thus either submerge between the fibers 6 of the cleaning covering 4 or be pivoted away from the cleaning roller 3.

During a regeneration operation of the wet cleaning device 1 in which liquid and/or dirt is to be removed from the cleaning roller 3 and diverted into the liquid channel 10, the deceleration element 5 is pushed between the fibers 6 of the cleaning covering 4 as illustrated on FIGS. 5 and 6, so that the regeneration process for cleaning the cleaning covering 4 described above in relation to FIGS. 2 to 4 can take place.

During a conventional wiping operation of the wet cleaning device 1, in which the cleaning roller 3 is placed upon a surface to be cleaned and picks up dirt from the surface to be cleaned, the deceleration element 5 and guide element 9 are instead pivoted away from the cleaning roller 3, wherein it makes sense in particular that the guide element 9 here close the liquid channel 10—as explained later in relation to FIG. 8, so that dirt and/or liquid cannot get out of the liquid channel 10 back in the direction of the cleaning roller 3.

During the regeneration operation, the deceleration element 5 is immovably arranged between the fibers 6 of the cleaning covering 4, and the fibers 6 move relative to the deceleration element 5. The guide element 9 here forms an elongation of the channel wall 11, so that liquid spun off by the fibers 6 can get directly from the deceleration element 5 into the liquid channel 10 with essentially no losses. This effectively prevents liquid from dripping back onto the cleaning roller 3.

In order to displace the guide element 9 relative to the cleaning roller 3, a lever 20 engages the guide element 9. For example, a user of the wet cleaning device 1 can manually grip the lever 20 and initiate an elongation of the guide element 9. However, it is alternatively also possible to automatically activate the lever 20, for example by means of an actuator, when switching from a wiping operation to a regeneration operation of the wet cleaning device 1.

As shown on FIG. 6, the cleaning roller 3 here has allocated to it a plurality of nozzles 21, with which liquid can be sprayed onto the cleaning covering 4 of the cleaning roller 3. The liquid is preferably applied to the cleaning roller 3 directly during and/or upon completion of a regeneration operation. The liquid exiting the nozzles 21 impacts the concavely designed surface of the guide element 9, and flows along the latter to the cleaning covering 4, so that the liquid can be guided between the fibers 6 by means of the guide element 9 or deceleration element 5.

Figure 7:
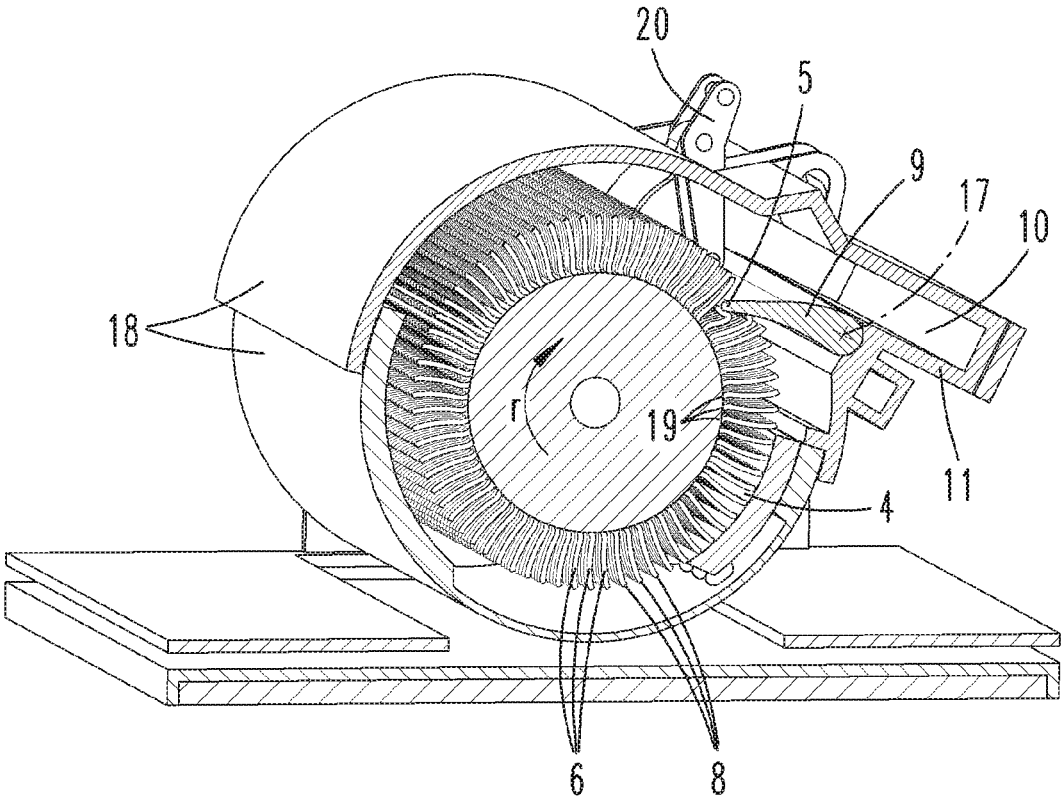
FIG. 7 is a perspective view of a partial area of the wet cleaning device with the deceleration element and guide element in a first position.
Figure 8:
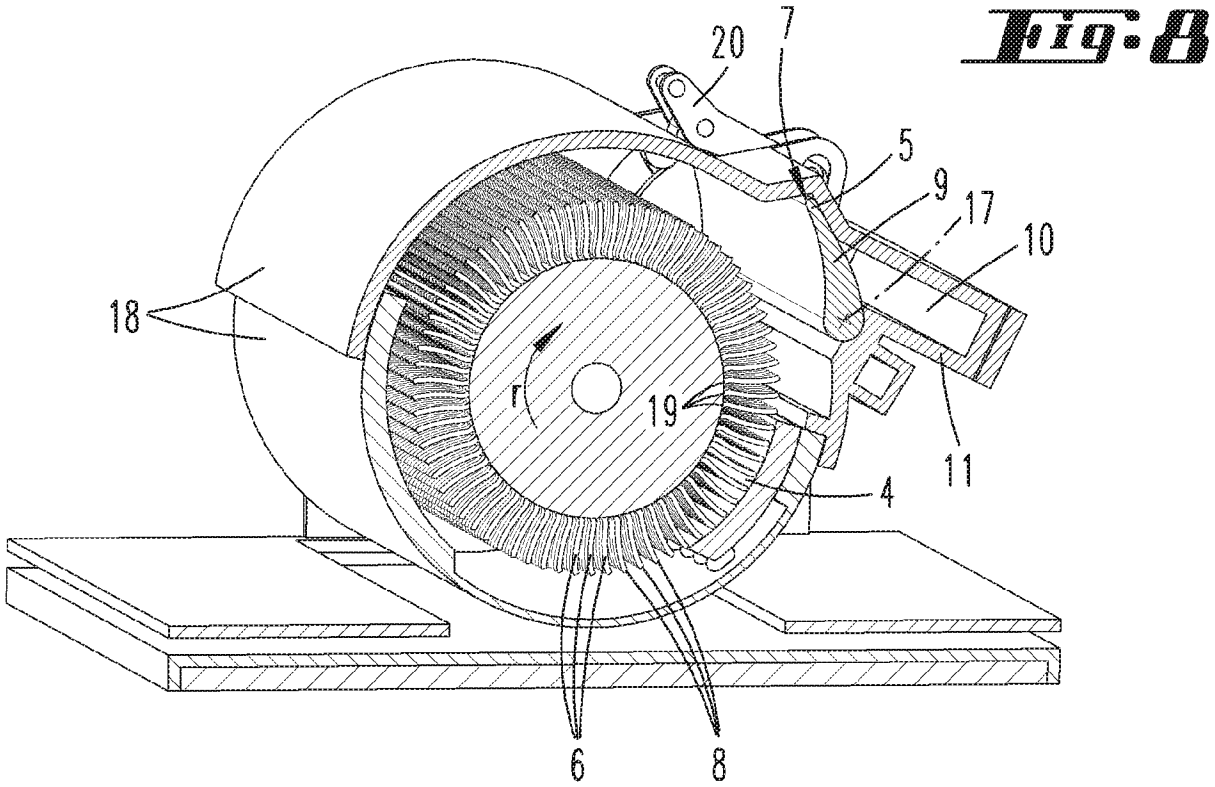
FIG. 8 is an illustration according to FIG. 7 with the deceleration element and guide element in a second position.

Finally, FIGS. 7 and 8 show a perspective view of the cleaning roller 3 and a housing 18 that encompasses the cleaning roller 3, which has a fixed (upper on the figures) housing part and a housing part that can be moved relative to the fixed housing part, and can be shifted for a wiping operation in the circumferential direction of the cleaning roller 3, so that the cleaning roller 3 can be lowered onto a surface to be cleaned. By contrast, during the regeneration operation, the two housing parts comprise a housing 18 that is completely closed in the circumferential direction, so that liquid spun away from the cleaning roller 3 cannot get outside of the wet cleaning device 1.

FIG. 7 shows a state in which the deceleration element 5 is pushed between the fibers 6 of the cleaning covering 4, so that liquid or dirt cannot get from the fibers 6 to the liquid channel 10, as explained above.

FIG. 8 shows a state of the deceleration element 5 and guide element 9 pivoted away from the cleaning roller 3, wherein the guide element 9 is arranged in front of the liquid channel 10 in such a way that the liquid channel 10 is sealed in a fluid-tight manner, and that dirt or liquid cannot get out of the liquid channel 10 and back to the cleaning roller 3.

REFERENCE LIST

1 Wet cleaning device
2 Roller axis
3 Cleaning roller
4 Cleaning covering
5 Deceleration element
6 Fiber
7 Impact edge
8 Free end
9 Guide element
10 Liquid channel
11 Channel wall
12 Base device
13 Attachment
14 Handle
15 Handgrip
16 Filler neck
17 Swiveling axis
18 Housing
19 Fiber root
20 Lever
21 Nozzle
d Roller diameter
L Fiber length
r Rotational direction
x Direction of movement
z Distance

The invention claimed is:

1. A wet cleaning device (1), in particular a wet wiping device, with a cleaning roller (3) that is rotatable around a roller axis (2) and having a cleaning covering (4), the cleaning covering (4) being a textile cleaning cloth having fibers (6) and being configured to absorb liquid between the fibers of the cleaning covering (4), wherein the fibers face radially outward due to the rotation of the cleaning roller (3), wherein the wet cleaning device (1) has a deceleration element (5) and a guide element (9) for supporting the removal and discharge of liquid and/or dirt from the cleaning roller (3) to a liquid channel (10), wherein the deceleration element (5) has an impact edge (7) that opposes the fibers (6) of the rotating cleaning covering (4), wherein the guide element (9) is arranged in a rotational direction (r) of the cleaning roller (3) behind the impact edge (7), and wherein, during a regeneration operation of the wet cleaning device (1), the impact edge (7) is arranged so far between the fibers (6) of the cleaning covering (4) that free ends (8) of the fibers (6) project outwardly in a radial direction beyond the impact edge (7), and in the event of an impact on the impact edge (7) are deflected in the direction of the guide element (9), wherein the fibers (6) of the cleaning covering (4) are made to straighten in front of the deceleration element (5) by exposure to centrifugal forces and are abruptly stopped at the deceleration element (5), and wherein the free ends (8) of the fibers (6) move around a new rotational midpoint on the deceleration element (5) with an increased angular velocity.

2. The wet cleaning device (1) according to claim 1, wherein the deceleration element (5) is immovably arranged on the wet cleaning device (1) during the regeneration operation.

3. The wet cleaning device (1) according to claim 1, wherein the deceleration element (5) and the guide element (9) are designed as a shared element, in particular are together designed as an arched element, which is convexly curved on a side facing away from the cleaning roller (3), and concavely curved on a side facing toward the cleaning roller (3).

4. The wet cleaning device (1) according to claim 1, wherein the impact edge (7) of the deceleration element (5) is concavely curved.

5. The wet cleaning device (1) according to claim 1, wherein the impact edge (7) of the deceleration element (5) has a distance (z) to the fiber roots (19) of the fibers (6) measuring ¼ to ½ a fiber length (L) of the fibers (6) in a radial direction relative to the roller axis (2).

6. The wet cleaning device (1) according to claim 1, wherein the guide element (9) extends proceeding from the deceleration element (5) to the liquid channel (10) in the rotational direction (r) of the cleaning roller (3), in particular forming an elongation of a channel wall (11) of the liquid channel (10).

7. The wet cleaning device (1) according to claim 1, wherein the guide element (9) and/or deceleration element (5) is mounted so that it can be displaced, in particular swiveled, relative to the cleaning roller (3), in particular on a channel wall (11) of the liquid channel (10).

8. The wet cleaning device (1) according to claim 1, wherein at least one nozzle (21) is allocated to the deceleration element (5) and/or guide element (9) for discharging liquid onto the cleaning roller (3), wherein the deceleration element (5) and/or guide element (9) can be arranged relative to a liquid outlet direction of the nozzle (21) at an angle of between 90° and 170°, in particular between 90° and 105°, so that liquid discharged from the nozzle (21) accelerated against the deceleration element (5) and/or guide element (9) reaches the cleaning roller along the deceleration element (5) and/or guide element (9) through exposure to gravity.

9. A method for operating a wet cleaning device (1), in particular a wet wiping device, in which liquid and/or dirt are removed from a cleaning covering (4) of a cleaning roller (3) of the wet cleaning device (1) rotating around a roller axis (2) during a regeneration operation, the cleaning covering (4) being a textile cleaning cloth having fibers (6) and being configured to absorb liquid between the fibers, and wherein the fibers face radially outward due to the rotation of the cleaning roller (3), wherein a deceleration element (5) and a guide element (9) arranged behind the deceleration element (5) in a rotational direction (r) of the cleaning roller (3) for removing and supplying the liquid and/or dirt from the cleaning roller (3) to a liquid channel (10) are arranged relative to the cleaning roller (3) in such a way that an impact edge (7) of the deceleration element (5) projects between the fibers (6) of the cleaning covering (4) to such an extent that free ends (8) of the fibers (6) project outwardly in a radial direction beyond the impact edge (7), and during an impact on the impact edge (7) are deflected in the direction of the guide element (9), wherein the fibers (6) of the cleaning covering (4) are made to straighten in front of the deceleration element (5) by exposure to centrifugal forces and are abruptly stopped at the deceleration element (5), and wherein the free ends (8) of the fibers (6) move around a new rotational midpoint on the deceleration element (5) with an increased angular velocity.

10. The method according to claim 9, wherein the free ends (8) of the fibers (6) deflected at the impact edge (7) impact the guide element (9).

11. The method according to claim 9, wherein the liquid and/or dirt spun off by the fibers (6) through impact on the impact edge (7) and/or guide element (9) is guided along the guide element (9) in the liquid channel (10).

* * * * *